US007605794B2

(12) United States Patent
Nurmi et al.

(10) Patent No.: US 7,605,794 B2
(45) Date of Patent: Oct. 20, 2009

(54) ADJUSTING THE REFRESH RATE OF A DISPLAY

(75) Inventors: Juha H-P Nurmi, Salo (FI); Jussi Koskela, Kaarina (FI)

(73) Assignee: Nokia Corporation, Espoo (FI)

( * ) Notice: Subject to any disclaimer, the term of this patent is extended or adjusted under 35 U.S.C. 154(b) by 639 days.

(21) Appl. No.: 11/317,669

(22) Filed: Dec. 22, 2005

(65) Prior Publication Data

US 2007/0146294 A1 Jun. 28, 2007

(51) Int. Cl.
*G09G 3/36* (2006.01)

(52) U.S. Cl. ..... 345/102; 345/204; 345/207

(58) Field of Classification Search ..... 345/55–103, 345/204–207

See application file for complete search history.

(56) References Cited

U.S. PATENT DOCUMENTS

| | | | | |
|---|---|---|---|---|
| 5,801,684 | A | 9/1998 | Uskali | |
| 2003/0016215 | A1 | 1/2003 | Slupe | |
| 2005/0134547 | A1* | 6/2005 | Wyatt | 345/102 |
| 2008/0204481 | A1* | 8/2008 | Mostinski | 345/690 |

FOREIGN PATENT DOCUMENTS

| | | |
|---|---|---|
| EP | 1077442 | 2/2001 |
| GB | 2345410 | 7/2000 |
| GB | 2378343 | 2/2003 |
| JP | 03092820 | 4/1991 |
| WO | WO 03/100759 | 12/2003 |
| WO | WO 2004/025617 | 3/2004 |

OTHER PUBLICATIONS

"Table 2: Power consumption of display module;" 1.3.3 Power Consumption of Display Module; Philips display module specification; specification date Oct. 10, 2004; retrieved from Internet on Dec, 21, 2005.

Jacob R. Lorch, et al; "Software Strategies for Portable Computer Energy Management"; IEEE Personal Communications, IEEE Communications Society, US; vol. 5, No. 3; Jun. 1998; pp. 60-73.

* cited by examiner

*Primary Examiner*—Alexander Eisen
*Assistant Examiner*—Christopher E Leiby
(74) *Attorney, Agent, or Firm*—Alfred A. Fressola; Ware, Fressola, Van Der Sluys & Adolphson LLP

(57) ABSTRACT

In a method for adjusting a refresh rate of a display, a current status of at least one lighting criterion is determined. The refresh rate is then adjusted depending on this determined status. A display module and an electronic device, respectively, comprise a display and a processing component adapted to perform such an adjustment. In a software program product, a software code is stored in a readable medium, the software code performing such an adjustment of the refresh rate of a display when being executed by a processor.

15 Claims, 8 Drawing Sheets

ADJUSTING THE REFRESH RATE OF A DISPLAY

FIELD OF THE INVENTION

The invention relates to a method for adjusting a refresh rate of a display. The invention relates further to a display module, an electronic device and a software program product enabling such an adjustment.

BACKGROUND OF THE INVENTION

Many electronic devices comprise a display for presenting information to a user.

In particular with mobile devices, it is of importance to limit the power consumption caused by the display, in order to save battery power and to obtain an acceptable stand-by time of the device. This is achieved with various measures.

Some displays can be used for example in two different display modes, namely a full display mode and a partial display mode.

In the full display mode, the entire active area of the display panel is used for a presentation. The user can see the best image quality in this mode, including for example moving images and full colors, etc. The refresh rate of the display panel may be fixed for instance to 60 Hz so that the user cannot see any abnormal visual effects, like a flickering in the image of the display.

In the partial display mode, only a part of the active area of the display panel is used for a presentation. The user can see the basic information in this mode, but the image quality may be lower than in the full display mode, for example by using only eight-color images, etc. Further, the refresh rate of the display panel may be fixed for instance to 30 Hz so that the user cannot see any abnormal visual effects.

The partial display mode results in a lower current consumption than the full display mode. Switching to the partial display mode can thus be used in a mobile device, which is able to provide a high quality presentation to a user in the full display mode, for reducing the total power consumption, and thus for increasing the standby time.

Normally, the refresh rate for a particular display mode is fixed. It has been proposed in addition, however, to reduce the refresh rate in both display modes, whenever the display is in an idle mode, resulting in a further reduction of the current consumption.

If the display is based on the Liquid Crystal Display (LCD) technology, usually a backlight is provided, in order to facilitate the recognition of the presentation on the LCD panel. This backlight can be switched off whenever it is not needed, in order to limit the current consumption. For instance, it may switch off automatically after a predetermined period of time during which the presentation remains unchanged and during which no user input is detected. Further, it may be switched on only in a dark environment. In addition, the intensity of the backlight may be varied inversely proportional to the intensity of ambient light.

The limitation of the current consumption becomes increasingly important as the resolution of the displays of mobile devices increases, for example from a Quarter Quarter Video Graphics Array (QQVGA) having a resolution of 128×160 pixels to a Video Graphics Array (VGA) having a resolution of 480×640 pixels. High resolution displays have a higher current consumption than low resolution displays, resulting in a shorter standby time.

SUMMARY OF THE INVENTION

It is an object of the invention to enable a further reduction of the current consumption of an electronic device having a display.

A method for adjusting a refresh rate of a display is proposed. The method comprises determining a status of at least one lighting criterion. The method further comprises adjusting the refresh rate depending on the determined status.

Moreover, a display module is proposed, which comprises a display adapted to operate with different refresh rates. The display module further comprises a processing component adapted to determine a status of at least one lighting criterion and adapted to adjust a refresh rate of the display based on the determined status.

Moreover, an electronic device is proposed, which comprises a corresponding display and a corresponding processing component. The electronic device may comprise to this end the proposed display module. It has to be noted, however, that the processing component of the electronic device could be realized as well at least partly externally to the display module.

The processing component of both the display module and of the electronic device can be implemented in hardware and/or in software. The processing component could be for instance a processor executing suitable software code for realizing the required functions. Alternatively, the processing component could be for instance a hard-wired logic realizing the required functions.

Finally, a software program product is proposed, in which a software code for adjusting the refresh rate of a display is stored in a readable medium. When being executed by a processor, the software code realizes the proposed method.

The invention proceeds from the consideration that the current consumption of an electronic device having a display depends on the refresh rate of the display. More specifically, a high refresh rate results in a high current consumption while a low refresh rate results in a low current consumption. The refresh rate, however, determines the quality of a presentation. Thus, it cannot be reduced arbitrarily, as a user should not notice any abnormal visual effects of the presented image due to a too low refresh rate. The invention proceeds further from the consideration that it depends on lighting criteria whether a user will notice such abnormal visual effects with given lighting conditions. For example, with a backlight switched on or with a high ambient light intensity, a user will notice abnormal visual effects at lower refresh rates than with no backlight switched on or with a low ambient light intensity. It is therefore proposed that the refresh rate of a display is made dependent on at least one lighting criterion.

It is an advantage of the invention that it allows a further reduction of the current consumption of an electronic device having a display, while preventing that a user sees abnormal visual effects of the presentation. The lower current consumption can be exploited for increasing the stand-by time of an electronic device, or for using a higher resolution without a reduction of the stand-by time.

The at least one lighting criterion may comprise for instance ambient light. Different statuses of the ambient light may be given by different intensities of the ambient light. In case the display includes means for providing a backlight, the at least one lighting criterion may comprise for instance the backlight, alternatively or in addition to another lighting criterion like ambient light. Different statuses of a backlight may then be given by the backlight being switched on or off. It is to be understood that if the intensity of the backlight can be varied, the statuses may also comprise the respective intensity of the backlight.

In a particularly simple embodiment of the invention, the at least one lighting criterion comprises only a backlight and the monitored statuses are 'switched on' and 'switched off'. The refresh rate may then be set to a higher value when the backlight is determined to be switched on and to a lower value when the backlight is determined to be switched off.

The current consumption can be reduced further while more reliably taking into account the visibility conditions, such as, if the at least one lighting criterion comprises for example a backlight and ambient light. In a first approach, the refresh rate may then be set to a higher value when the backlight is determined to be switched on, and the refresh rate may be varied at lower values depending on a determined intensity of the ambient light when the backlight is determined to be switched off. In a second approach, the refresh rate may be varied depending on a determined intensity of said ambient light regardless of whether the backlight is switched on or off. When the backlight is determined to be switched on, the refresh rate is only varied at higher values compared to when the backlight is switched off.

In another embodiment of the invention, the at least one lighting criterion comprises equally a backlight and ambient light. The refresh on the display is stopped completely when the backlight is determined to be switched off and a determined intensity of ambient light falls below a predetermined threshold value. Such a low ambient light may be reached for instance when the device is placed in a dark room, or put into a pocket or a bag. Stopping the refresh on the display completely by setting the refresh rate to zero enables significant power savings during long periods of time. Stopping the refresh may be the only enabled adjustment of the refresh rate depending on some lighting criterion, but this embodiment may also be combined with any other kind of adjustment of the refresh rate.

While a refresh rate adjustment can be performed for full display mode and/or partial display mode, the last presented embodiment may be implemented in particular for the partial display mode.

It is to be understood that the requirement that a refresh rate is set to a higher value when the backlight is switched on than when the backlight is switched off does not imply that any refresh rate value that can be selected in case the backlight is switched on has to be higher than any refresh rate value that can be selected in case the backlight is switched off. It is rather sufficient that there is at least one ambient light intensity, at which the refresh rate value that is selected in case the backlight is switched on is higher than the refresh rate value that is selected in case the backlight is switched off. Further, there should be no ambient light intensity, at which the refresh rate value that is selected in case the backlight is switched on is lower than the refresh rate value that is selected in case the backlight is switched off. For instance, overlapping or non-overlapping refresh rate ranges could be selected for the case that the backlight is switched on and for the case that the backlight is switched off.

It is further to be noted that various other criteria could be used in addition for selecting the actual refresh rate, like the activation of an idle mode, etc.

The invention can be employed for any electronic device having a display. In view of the enabled power savings, it is of particular advantage for mobile devices, like mobile phones and personal digital assistants (PDAs), etc.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not drawn to scale and that they are merely intended to conceptually illustrate the structures and procedures described herein.

DETAILED DESCRIPTION OF THE INVENTION

Figure 1:
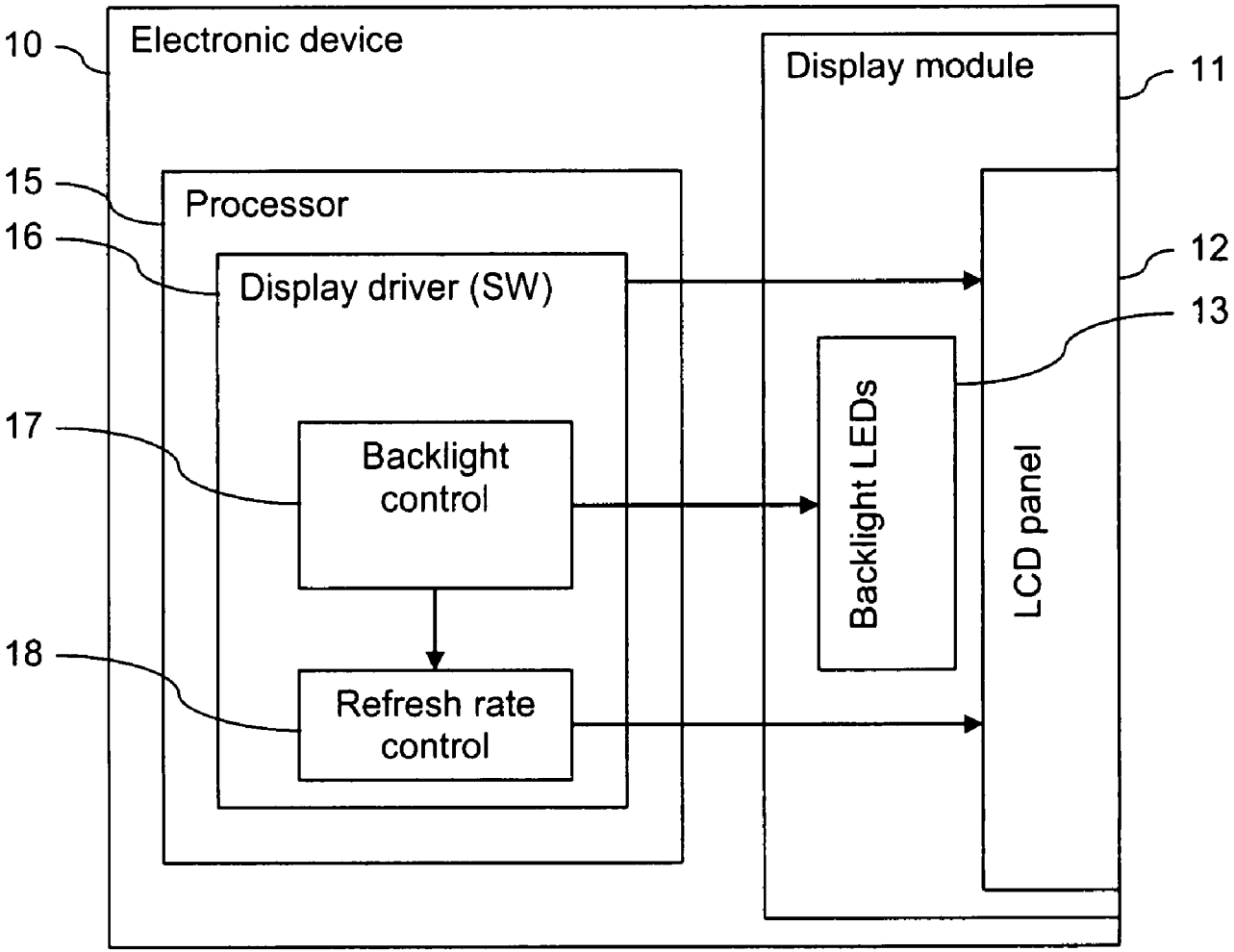
FIG. 1 is a schematic block diagram of an electronic device according to a first embodiment of the invention.

FIG. 1 is a schematic block diagram of an exemplary electronic device having a display, which enables a power saving according to a first embodiment of the invention.

The electronic device 10 can be for example a mobile phone or a PDA. It comprises a display module 11 with an LCD panel 12 and a backlight section 13 including LEDs.

The electronic device 10 further comprises a processor 15, which is adapted to execute various installed software codes. One installed software code is a display driver 16. The display driver 16 comprises among other components a backlight control component 17 and a refresh rate control component 18. The display driver 16 may be realized in a conventional manner, except for the refresh rate control component 18.

Figure 2:
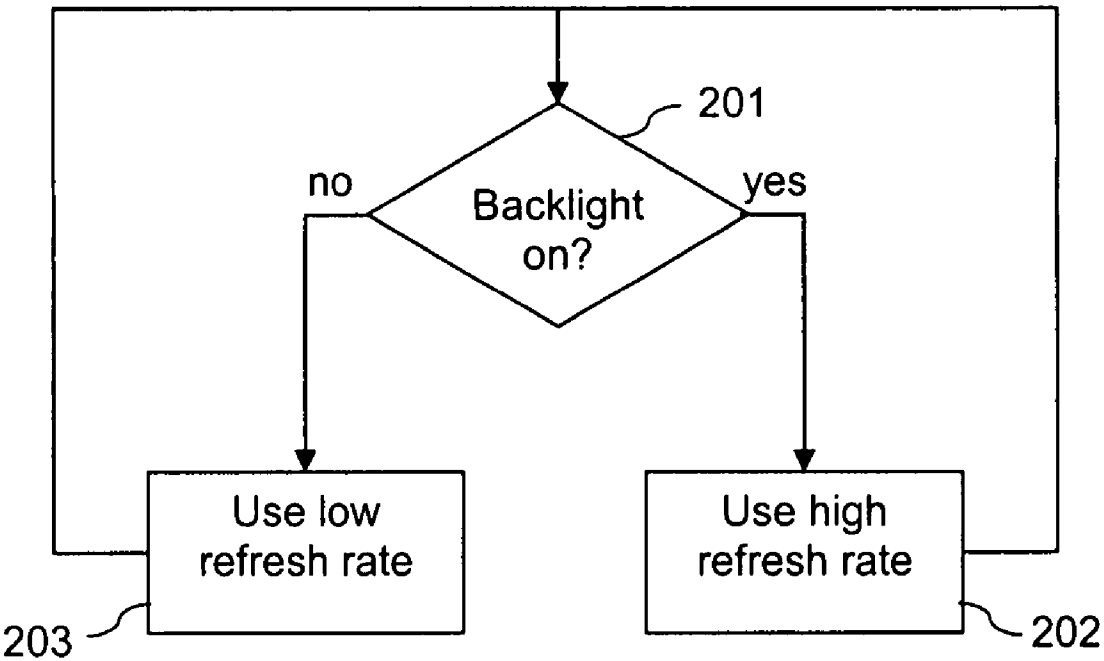
FIG. 2 is a flow chart illustrating an operation in the device of FIG. 1.

The operation according to the invention of the electronic device 10 of FIG. 1 will now be described with reference to the flow chart of FIG. 2.

In general, the display driver 16 may drive the LCD panel 12 in a conventional manner, depending for instance on some information received from another application that is to be presented to a user on the LCD panel 12. In this scope, the display driver 16 also selects a full display mode or a partial display mode in a conventional manner. In accordance with the invention, the display driver 16 moreover controls the refresh rate of the LCD panel 12 by means of the refresh rate control component 18. In addition, the backlight control component 17 of the display driver 16 may take care of switching the LEDs of the backlight section 13 on and off as required in a conventional manner.

The refresh rate control component 18 receives from the backlight control component 17 a corresponding indication whenever it switches the LEDs of the backlight section 13 on or off. The refresh rate control component 18 determines from this indication whether the backlight is switched on. (step 201)

When the backlight is switched on, the refresh rate control component 18 selects a predetermined high refresh rate for the LCD panel 12 and controls the LCD panel 12 accordingly (step 202). When the backlight is switched off, the refresh rate control component 18 selects a predetermined low refresh rate for the LCD panel 12 and controls the LCD panel 12 accordingly (step 203).

The operation is the same for full display mode and partial display mode. It has to be noted, however, that different predetermined high and/or low refresh rates may be used for both modes.

Figure 3:
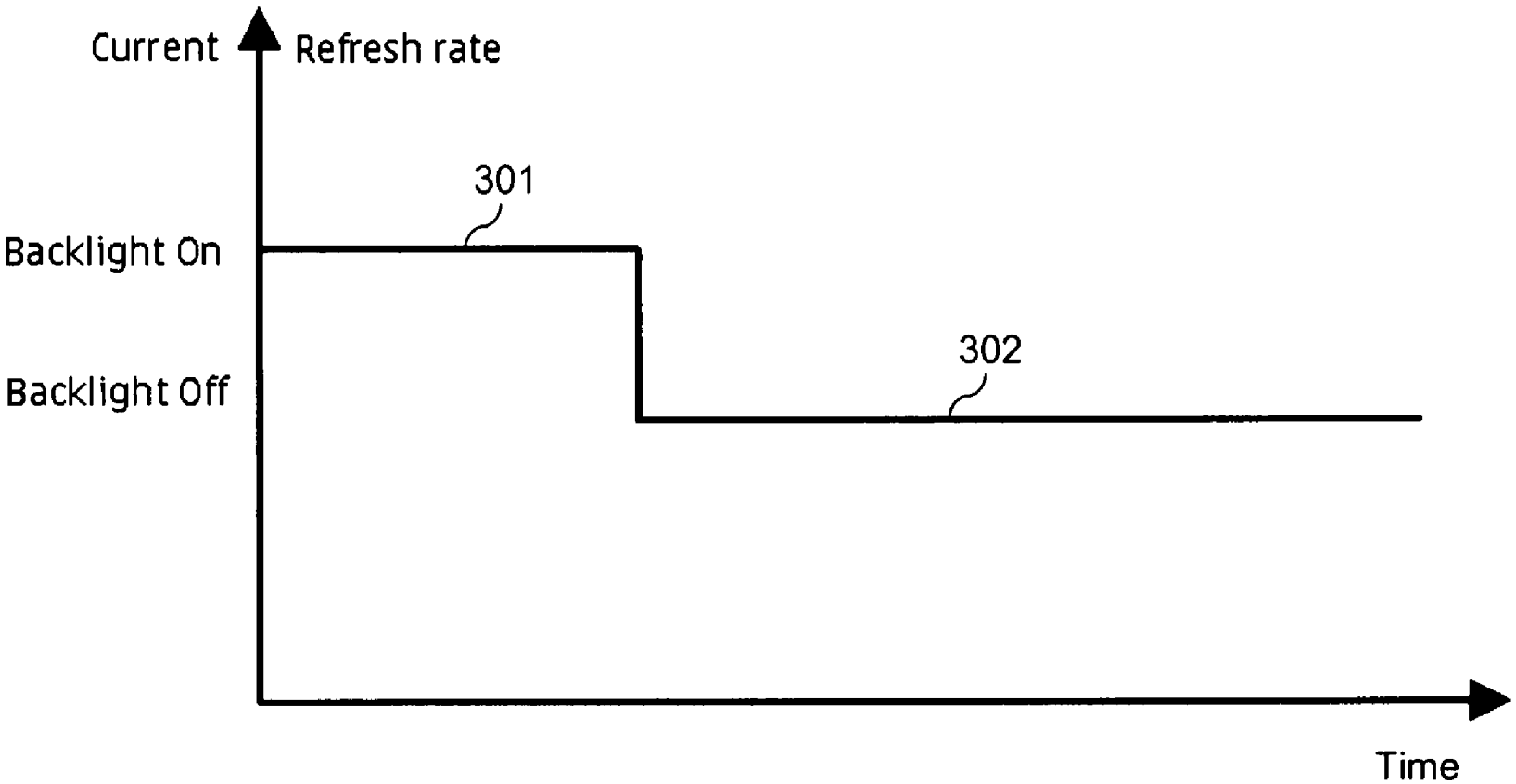
FIG. 3 is a diagram illustrating a possible course of a refresh rate in the device of FIG. 1.

FIG. 3 illustrates a course of the refresh rate that may result with the full display mode or the partial display mode when the backlight is switched from on to off.

While the backlight is switched on, the refresh rate of the LCD panel 12 is set to a higher value 301. As a result, also the current consumption is high. As soon as the backlight is switched off, the refresh rate of the LCD panel 12 is reduced to a lower value 302. As a result, also the current consumption is reduced. Thus, the standby time of the battery of the electronic device 10 is increased.

Figure 4:
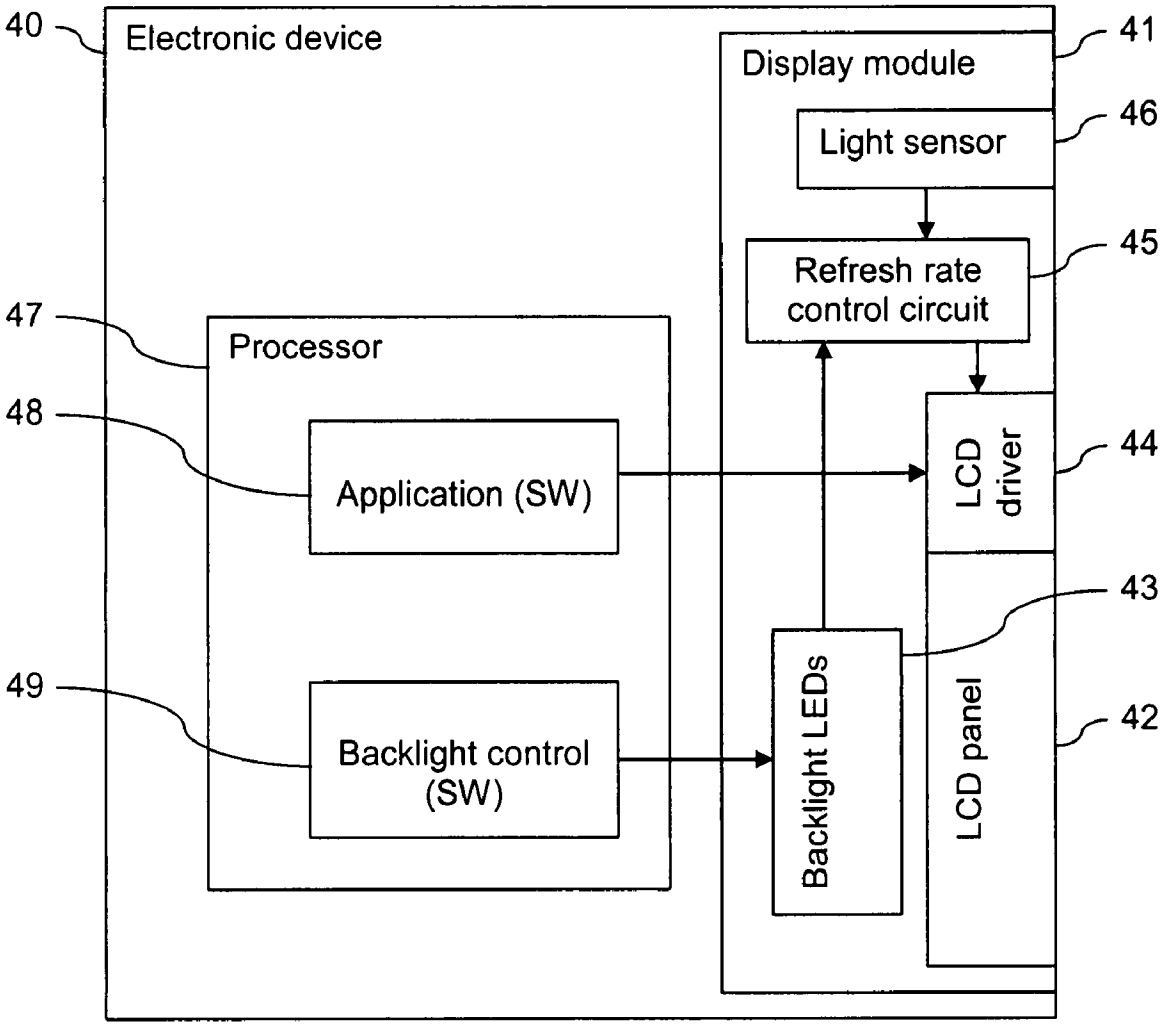
FIG. 4 is a schematic block diagram of an electronic device according to a second embodiment of the invention.

FIG. 4 is a schematic block diagram of an exemplary electronic device having a display, which enables a power saving according to a second embodiment of the invention.

The electronic device 40 can be for example a mobile phone or a PDA. It comprises a display module 41 with an LCD panel 42 and a backlight section 43 including LEDs.

In this exemplary embodiment, the display module 41 comprises as well an LCD driver 44, which may be realized in a conventional manner. Further the display module 41 comprises a refresh rate control circuit 45 and a light sensor 46, like a photo diode. In this embodiment, the LCD driver 44 and the refresh rate control circuit 45 are implemented in hardware.

The electronic device 40 further comprises a processor 47, which is adapted to execute various installed software codes, for instance an application 48 generating information that is to be presented to a user via the LCD panel 42 and an application 49 controlling the backlight section 43.

Figure 5:
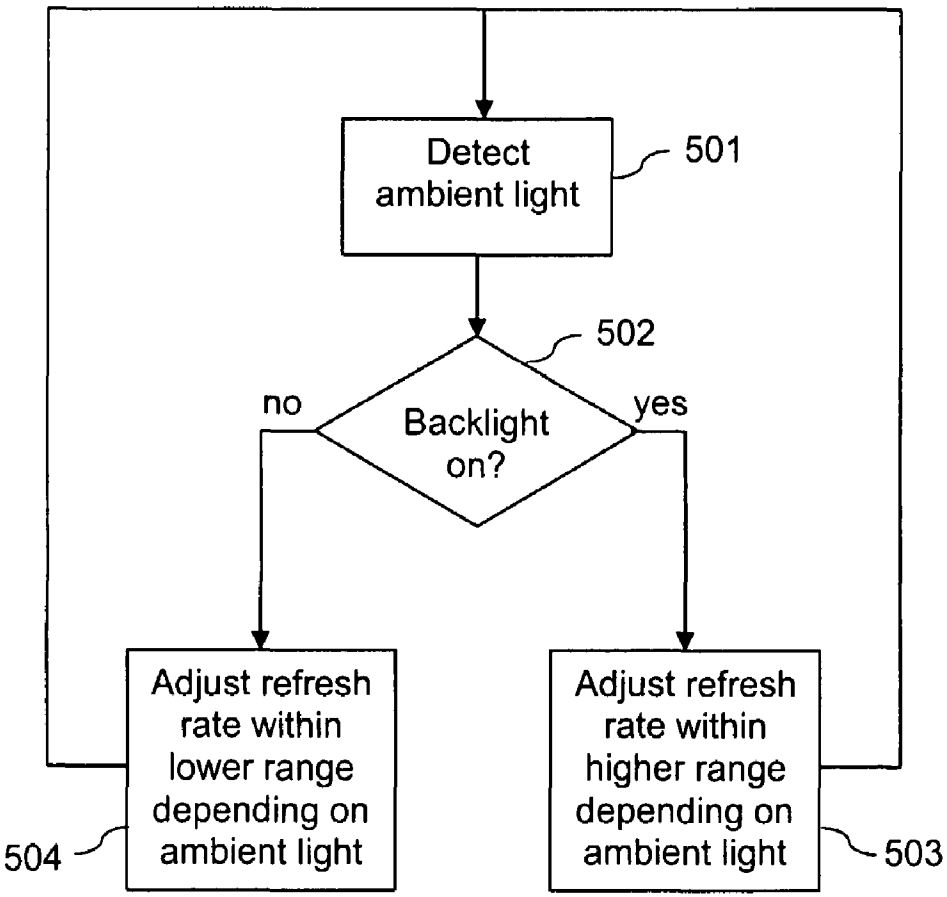
FIG. 5 is a flow chart illustrating an operation in the device of FIG. 4.

The operation according to the invention of the electronic device 40 of FIG. 4 will now be described with reference to the flow chart of FIG. 5.

In general, the LCD driver 44 may drive the LCD panel 42 in a conventional manner, depending for instance on some information that is received via a suitable interface from an application 48 executed by the processor 47 and that is to be presented to a user on the LCD panel 42. In this scope, the LCD driver 44 may also select a full display mode or a partial display mode in a conventional manner. In addition, the backlight control component 49 may take care of switching the LEDs of the backlight section 43 on and off as required in a conventional manner.

In the presented second embodiment of the invention, the refresh rate control circuit 45 moreover controls the refresh rate of the LCD panel 42 applied by the LCD driver 44.

The light sensor 46 constantly monitors the intensity of the ambient light and provides a corresponding measurement value to the refresh rate control circuit 45 (step 501).

In addition, the refresh rate control circuit 45 measures the current to the LEDs of the backlight section 43. Thereby, the refresh rate control circuit 45 is able to determine whether the backlight is switched on or off. More specifically, when the refresh rate control circuit 45 detects a current, it can assume that the backlight is switched on, and if it detects basically no current, it can assume that the backlight is switched off. (step 502)

Whenever the refresh rate control circuit 45 determines that the backlight is switched on, it selects a high refresh rate range. Within this high refresh rate range, it controls the LCD panel 42 depending on the detected intensity of the ambient light. That is, with higher intensities of the ambient light the refresh rate is set to higher values within the high refresh rate range than with lower intensities of the ambient light. (step 503)

Whenever the refresh rate control circuit 45 determines that the backlight is switched off, it selects a low refresh rate range. Within this low refresh rate range, it controls the LCD panel 42 depending on the detected ambient light. That is, with higher intensities of the ambient light the refresh rate is set to higher values within the low refresh rate range than with lower intensities of the ambient light. (step 504)

Figure 6:
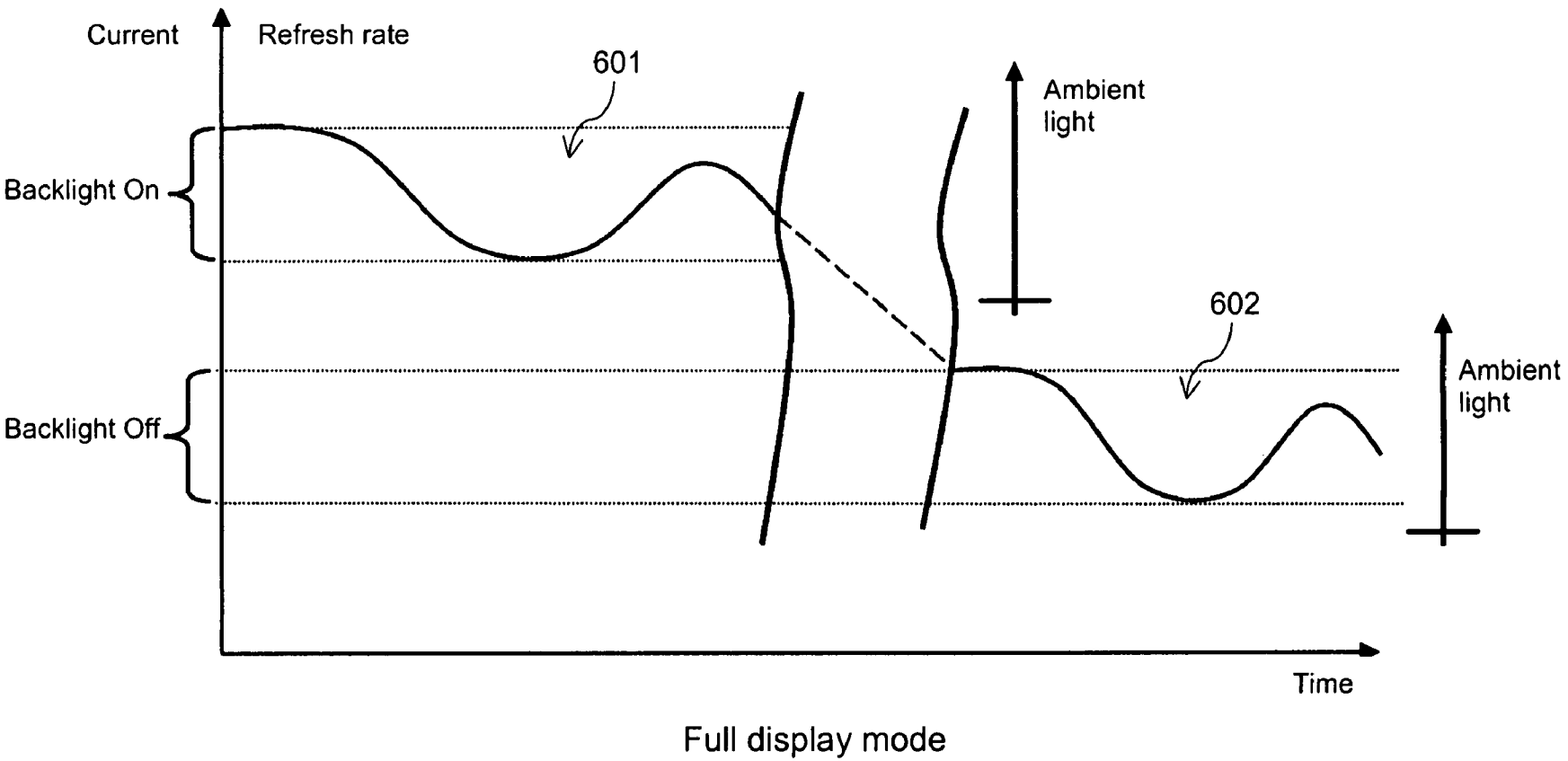
FIG. 6 is a diagram illustrating a possible course of a refresh rate in the device of FIG. 4 in case of a full display mode.

FIG. 6 is a diagram illustrating a course of the refresh rate that may result during full display mode, when the backlight is switched from on to off.

In the diagram, the refresh rate—and thus the current consumption—is plotted against time. A first, high refresh rate range 601 and a second, low refresh rate range 602 are indicated by respective dashed lines.

At the beginning, the backlight is switched on, and the refresh rate varies analogously to the detected intensity of the ambient light within the high refresh rate range 601. As a result also the current consumption varies at a high level.

Then, the backlight is switched off, and the refresh rate varies after a short transition period analogously to the detected intensity of the ambient light within the low refresh rate range 602. As a result also the current consumption varies at a low level.

As the refresh rate may vary analogously to the detected intensity of the ambient light within different ranges 601, 602, two separate scales are depicted for the ambient light.

Thus, the refresh rate is always as low as possible, that is, just sufficiently high for ensuring that the user does not note any abnormal effects.

In the partial display mode, it is even possible to stop the refresh on the display completely, if the backlight is switched off and the intensity of the ambient light is low enough. Under these conditions, the user is not able to see a presentation on the LCD panel 42 anyhow. This may be the case, for example, at night time or when the device is located in a pocket.

Figure 7:
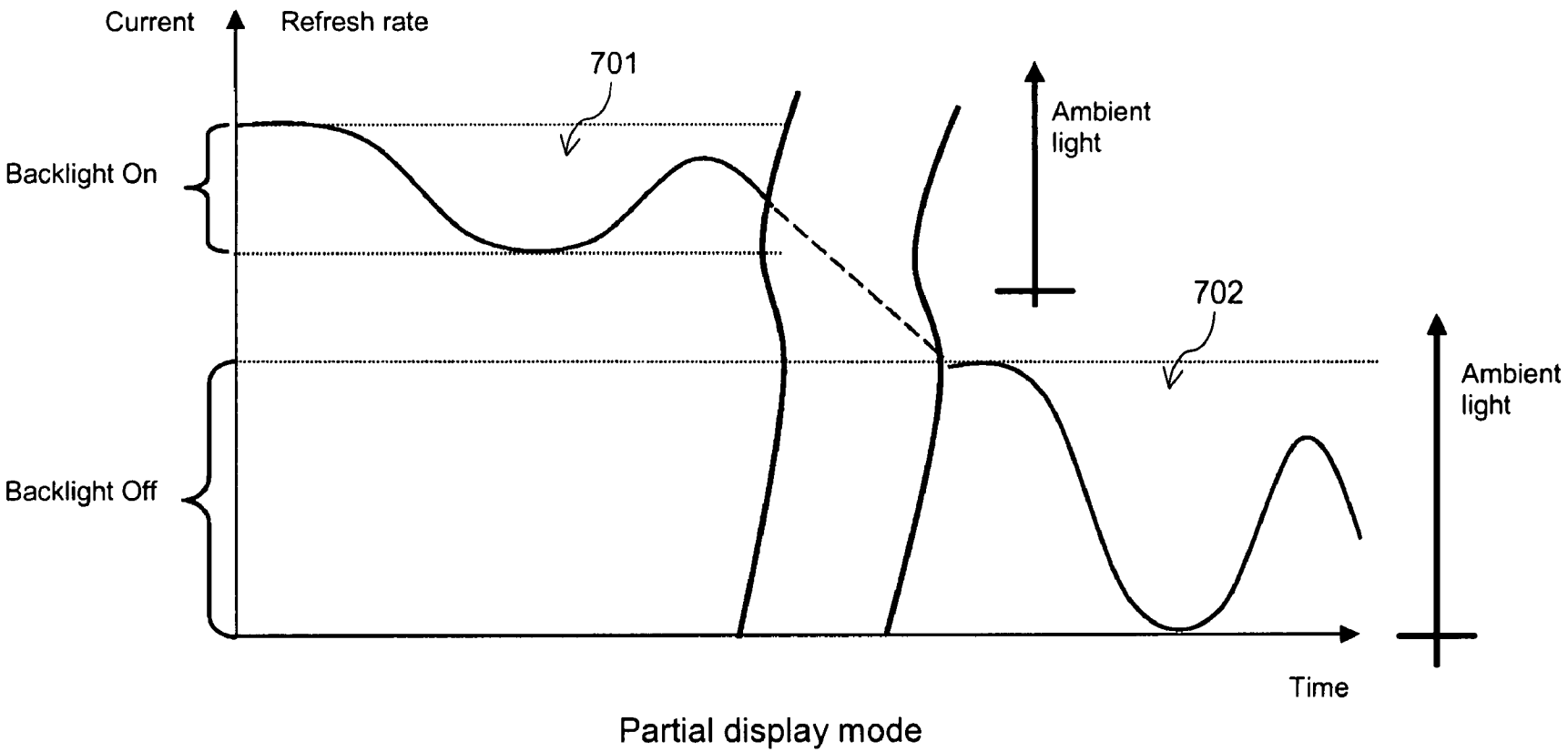
FIG. 7 is a diagram illustrating a possible course of a refresh rate in the device of FIG. 4 in case of a partial display mode.

FIG. 7 is a diagram illustrating the course of the refresh rate—and thus the current consumption—that may result during the partial display mode, when the backlight is switched from on to off.

Also in this diagram, the refresh rate is plotted against time. A first, high refresh rate range 701 and a second, low refresh rate range 702 are indicated by respective dashed lines. The high refresh rate range 701 may correspond to the high refresh rate range 601 selected for the full display mode. Also the higher limit for the low refresh rate range 702 may be the same as the higher limit for the low refresh rate range 602 selected for the full display mode. In contrast to the full display mode, however, the lower limit for the low refresh rate range 702 is set to zero for the partial display mode. Thus, the low refresh rate range is larger for the partial display mode than for the full display mode.

At the beginning, the backlight is switched on, and the refresh rate varies analogously to the detected intensity of the ambient light within the high refresh rate range 701. As a result also the current consumption varies at a high level.

Then, the backlight is switched off, and the refresh rate varies after a short transition period analogously to the detected intensity of the ambient light within the low refresh rate range 702. As a result also the current consumption varies at a low level. Whenever the intensity of the ambient light is very low, the refresh rate reaches a value of zero.

As the refresh rate may vary analogously to the detected intensity of the ambient light within different ranges 701, 702 again, two separate scales are depicted for the ambient light.

With this approach, it is possible to reduce the current consumption to zero during a considerable duration of time. If the intensity of the ambient light is very low, for instance, during eight hours of night time, the current consumption can be reduced to zero during 33% of the time each day.

The detected intensity of the ambient light can be mapped to a respective refresh rate in various ways. In a particularly simple solution, there may be for example a linear relation between the detected intensity of the ambient light and the refresh rate within the considered refresh rate range, with an upper and a lower limit for the refresh rate.

Figure 8:
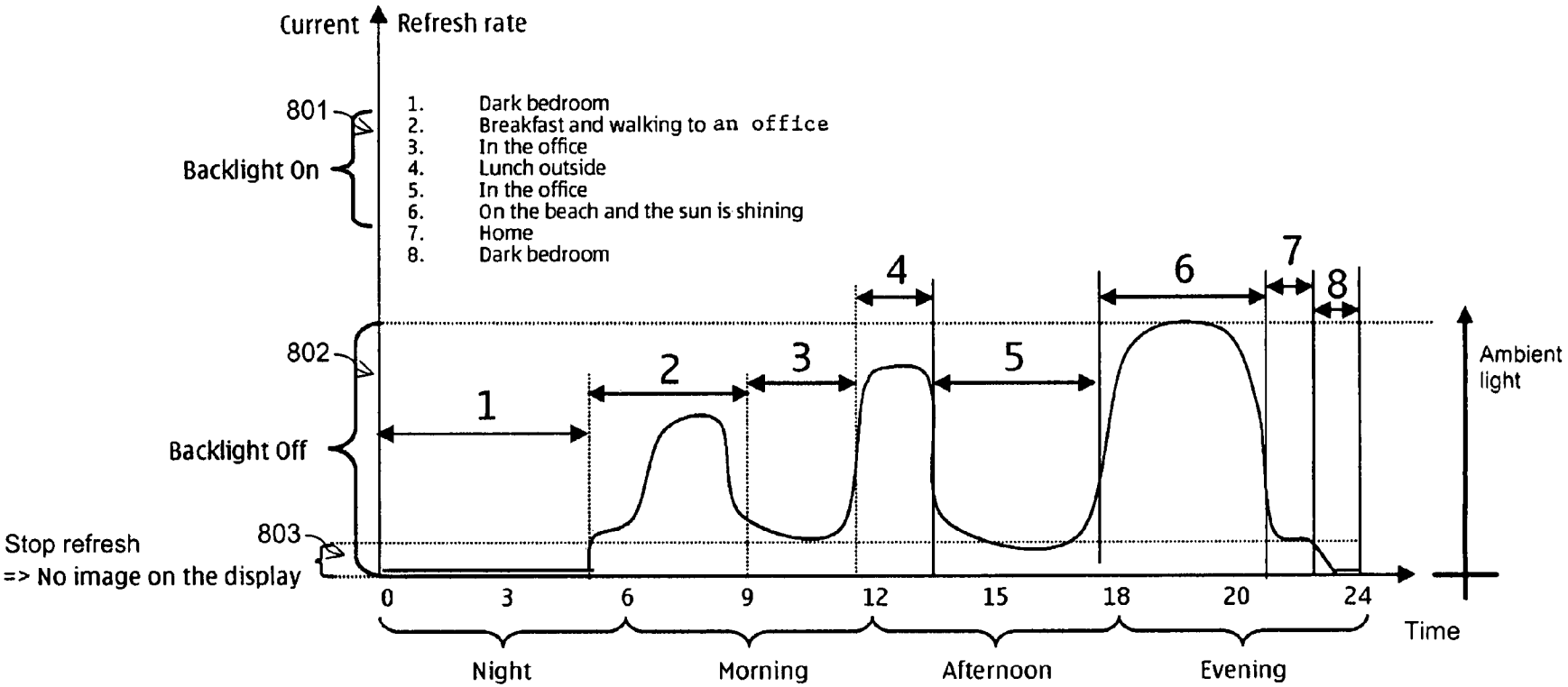
FIG. 8 is a diagram illustrating a possible course of a refresh rate in the device of FIG. 4 during one day in case of a partial display mode while the backlight is switched off.

FIG. 8, finally, is a diagram illustrating an exemplary course of the refresh rate—and thus the current consumption—over a whole day when the electronic device 40 is set to a partial display mode and the backlight is switched off. The electronic device 40 is assumed to be a mobile phone.

In the diagram, the refresh rate is plotted against time. The indicated first, high refresh rate range 801, which is defined for the case that the backlight is switched on, is not considered. The upper limit of a second, low refresh rate range 802 is indicated by a first dashed line. The lower limit for this second, low refresh rate range is zero. A stop-refresh subrange 803 within the low refresh rate range 802 is arranged between a further dashed line and the time-axis. Since only the low refresh rate range 802 is considered in the presented example, a scale for the ambient light is depicted only for this low refresh rate range 802.

During a first period of time '1' in the night, the mobile phone 40 is located in a dark bedroom. Thus, the measured intensity of the ambient light is very low and lies within stop-refresh subrange 803. Consequently, the refresh rate is set to zero by the refresh rate control circuit 45 and the refresh on the LCD panel 42 is stopped.

During a second period of time '2', the user takes breakfast and walks to an office, always taking along the mobile phone 40. During breakfast, the measured intensity of the ambient light is still quite low, but increases above the limit at which the refresh on the LCD panel 42 is to be stopped. A refresh on the LCD panel 42 is thus started, but the refresh rate is kept at low values within the low refresh rate range 802. During the walk to the office, the measured intensity of the ambient light out of doors is much higher than indoors, and the refresh rate is set to considerably higher values within the low refresh rate range 802.

During a third period of time '3', the user stays in the office for a while. In the office, the measured intensity of the ambient light is quite low again, and the refresh rate is set to low values within the low refresh rate range 802 just above the stop-refresh limit again.

During a fourth period of time '4', the user takes lunch outside. During noon, the measured intensity of the ambient light out of doors is somewhat higher than in the morning, and the refresh rate is thus set to still higher values within the low refresh rate range 802 than in period '2'.

During a fifth period of time '5', the user has returned to the office. In the office, the measured intensity of the ambient light is quite low again, and the refresh rate is set to low values within the low refresh rate range 802 just above the stop-refresh limit again.

During a sixth period of time '6', the user leaves the office and goes to the beach. The sun is shining, and the measured intensity of the ambient light is very high. The refresh rate, which is set correspondingly, reaches for a while even the upper limit of the low refresh rate range 802.

During a seventh period of time '7', the user goes home. At home, the measured intensity of the ambient light is quite low again, and the refresh rate is set to low values within the low refresh rate range 802 just above the stop-refresh limit.

During an eighth period of time '8', the mobile phone 40 is located again in a dark bedroom. Thus, the measured intensity of the ambient light is very low and lies within stop-refresh subrange 803. Consequently, the refresh rate is set to zero again by the refresh rate control circuit 45 and the refresh on the LCD panel 42 is stopped.

While there have been shown and described and pointed out fundamental novel features of the invention as applied to preferred embodiments thereof, it will be understood that various omissions and substitutions and changes in the form and details of the devices and methods described may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for adjusting a refresh rate of a display, said method comprising:

determining a current status of at least one lighting criterion, wherein said at least one lighting criterion comprises a backlight and ambient light, wherein different statuses of said backlight are given by said backlight being switched on or off, and wherein different statuses of said ambient light are given by different intensities of said ambient light; and adjusting said refresh rate depending on said determined status, wherein said refresh rate is set to a higher value when said backlight is determined to be switched on, or said refresh rate is varied at higher values depending on a determined intensity of said ambient light when said backlight is determined to be switched on, and wherein said refresh rate is varied at lower values depending on a determined intensity of said ambient light when said backlight is determined to be switched off.

2. The method according to claim 1, wherein a refresh on said display is stopped, when said backlight is determined to be switched off and a determined intensity of ambient light falls below a predetermined threshold value.

3. The method according to claim 2, wherein said refresh rate adjustment is performed for a full display mode and for a partial display mode, and wherein only in said partial display mode a refresh on said display is stopped, when said backlight is determined to be switched off and a determined intensity of ambient light falls below a predetermined threshold value.

4. The method according to claim 1, wherein said refresh rate adjustment is performed for at least one of a full display mode and a partial display mode.

5. An apparatus comprising:

a display adapted to operate with different refresh rates; and a processor configured to determine a current status of at least one lighting criterion and configured to adjust a refresh rate of said display based on said determined status;

wherein said at least one lighting criterion comprises a backlight and ambient light, wherein different statuses of said backlight are given by said backlight being switched on or off, and wherein different statuses of said ambient light are given by different intensities of said ambient light;

wherein said processor is configured to set said refresh rate to a higher value when said backlight is determined to be switched on, or to vary said refresh rate at higher values depending on a determined intensity of said ambient light when said backlight is determined to be switched on; and wherein said processor is configured to vary said refresh rate at lower values depending on a determined intensity of said ambient light when said backlight is determined to be switched off.

6. The apparatus according to claim 5, wherein said processor is configured to stop a refresh on said display, when said backlight is determined to be switched off and a determined intensity of ambient light falls below a predetermined threshold value.

7. The apparatus according to claim 6, wherein said processor is configured to perform said refresh rate adjustment for a full display mode and for a partial display mode, and to stop a refresh on said display only in said partial display mode when said backlight is determined to be switched off and a determined intensity of ambient light falls below a predetermined threshold value.

8. The apparatus according to claim 5, wherein said processor is configured to perform said refresh rate adjustment for at least one of a full display mode and a partial display mode.

9. The apparatus according to claim 5, wherein said apparatus is an electronic device or a display module for an electronic device.

10. The apparatus according to claim 5, wherein said apparatus is mobile phone or a personal digital assistant.

11. A software program product in which a software code for adjusting the refresh rate of a display is stored in a readable medium, said software code realizing the following steps when being executed by a processor:

determining a current status of at least one lighting criterion, wherein said at least one lighting criterion comprises a backlight and ambient light, wherein different statuses of said backlight are given by said backlight being switched on or off, and wherein different statuses of said ambient light are given by different intensities of said ambient light; and adjusting said refresh rate depending on said determined status wherein said refresh rate is set to a higher value when said backlight is determined to be switched on, or said refresh rate is varied at higher values depending on a determined intensity of said ambient light when said backlight is determined to be switched on; and wherein said refresh rate is varied at lower values depending on a determined intensity of said ambient light when said backlight is determined to be switched off.

12. The software program product according to claim 11, wherein said software code is adapted to stop a refresh on said display, when said backlight is determined to be switched off and a determined intensity of ambient light falls below a predetermined threshold value.

13. The software program product according to claim 12, wherein said software code is adapted to perform said refresh rate adjustment for a full display mode and for a partial display mode, and to stop a refresh on said display only in said partial display mode, when said backlight is determined to be switched off and a determined intensity of ambient light falls below a predetermined threshold value.

14. The software program product according to claim 11, wherein said software code is adapted to perform said refresh rate adjustment for at least one of a full display mode and a partial display mode.

15. An apparatus comprising:

means for determining a current status of at least one lighting criterion, wherein said at least one lighting criterion comprises a backlight and ambient light, wherein different statuses of said backlight are given by said backlight being switched on or off, and wherein different statuses of said ambient light are given by different intensities of said ambient light; and means for adjusting a refresh rate of a display based on said determined status by setting said refresh rate to a higher value when said backlight is determined to be switched on, or by varying said refresh rate at higher values depending on a determined intensity of said ambient light when said backlight is determined to be switched on; and by varying said refresh rate at lower values depending on a determined intensity of said ambient light when said backlight is determined to be switched off.

* * * * *

UNITED STATES PATENT AND TRADEMARK OFFICE

CERTIFICATE OF CORRECTION

PATENT NO. : 7,605,794 B2
APPLICATION NO. : 11/317669
DATED : October 20, 2009
INVENTOR(S) : Nurmi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 941 days.

Signed and Sealed this

Fifth Day of October, 2010

David J. Kappos

David J. Kappos
*Director of the United States Patent and Trademark Office*